United States Patent [19]

Moore

[11] Patent Number: 4,523,645

[45] Date of Patent: Jun. 18, 1985

[54] METHOD OF AND APPARATUS FOR MOVING REELED MATERIAL INTO AND RETRIEVING IT FROM THE UPPER END OF A WELL BORE IN THE EARTH'S SURFACE

[76] Inventor: Boyd B. Moore, 427 Mignon, Houston, Tex. 77024

[21] Appl. No.: 576,888

[22] Filed: Feb. 3, 1984

Related U.S. Application Data

[63] Continuation of Ser. No. 267,087, May 26, 1981.

[51] Int. Cl.[3] ..... E21B 19/22

[52] U.S. Cl. ..... 166/385; 166/77.5; 175/162; 254/269; 254/284

[58] Field of Search ..... 166/77, 379, 380, 382, 166/385; 175/162; 254/269, 281, 284, 285, 277, 326, 335, 336, 379

[56] References Cited

U.S. PATENT DOCUMENTS

| | | | |
|---|---|---|---|
| 1,683,948 | 9/1928 | Becker | 254/277 X |
| 2,070,912 | 2/1937 | McDermott | 175/50 X |
| 2,667,333 | 1/1954 | Martin | 254/277 X |
| 2,678,190 | 5/1954 | Crake | 254/285 |
| 2,795,396 | 6/1957 | Davidson | 254/379 X |
| 3,035,414 | 5/1962 | Smith | 254/379 X |
| 3,275,300 | 9/1966 | Delacour et al. | 254/285 X |
| 3,291,451 | 12/1966 | Trollope | 254/379 X |
| 3,369,600 | 2/1968 | Bohlmann, Jr. | 254/336 X |
| 3,403,728 | 10/1968 | Richardson et al. | 254/277 X |
| 3,934,856 | 1/1976 | Shaw | 254/379 X |

FOREIGN PATENT DOCUMENTS

| | | | |
|---|---|---|---|
| 715415 | 8/1965 | Canada | 175/162 |

*Primary Examiner*—Stephen J. Novosad
*Assistant Examiner*—William P. Neuder
*Attorney, Agent, or Firm*—Jack W. Hayden

[57] ABSTRACT

Material is supported on rotatable reel means with one end extending therefrom for connection with a well string for a well bore. Movable means support the portion of material extending between the reel means and well string. Means lower and raise the movable means whereby some of the supported material may be selectively moved into the well bore or removed therefrom along with the well string, if desired, without rotating the reel means on which it is supported during the lowering or removing procedure. Means rotate the reel support means to selectively pay out additional material for movement into the well bore or to reeve material removed from the well bore thereon. Control and actuating means effect operation of the various means as desired. Means support the well string and the material to enable the lowering of the well string and material into, and removal thereof, from the well bore.

49 Claims, 12 Drawing Figures

METHOD OF AND APPARATUS FOR MOVING REELED MATERIAL INTO AND RETRIEVING IT FROM THE UPPER END OF A WELL BORE IN THE EARTH'S SURFACE

CROSS REFERENCE TO RELATED APPLICATION

This is a continuation of co-pending application Ser. No. 267,087 filed May 26, 1981.

SUMMARY OF THE INVENTION

It is sometimes desirable to move reeved material such as cable, electrical and/or fluid conductor into a well bore such as oil, gas or thermal well bore. Generally speaking, such reeved material is supported on reel means, the weight of which with the reeved material thereon may be substantial, even thousands of pounds. Heretofore, substantial difficulty has been encountered in moving the reeved material into the well bore, in that it has been generally accomplished by rotating the reel means so as to unreeve the reeved material from the reel means and feed it into the well bore.

However, rotation of the reel means entails some problems and difficulties since rotation thereof may create a flywheel effect in that energy is stored as the reel rotates which may make it difficult to slow or stop the reel means when desired.

Also, it is not uncommon to desire to feed the reeved material into the well bore along with another member such as a well string composed of a plurality of tubular joints connected in end-to-end relation. In such case, it can be appreciated that the well string is formed by stepwise connecting into the well string a tubular joint or tubular joints and then lowering the connected tubular joint or tubular joints into the well bore. The upper end of the tubular joint or tubular joints is positioned and held above the upper end of the well bore so that the next tubular joint or tubular joints may be connected therewith and then lowered into the well bore.

When it is desired to simultaneously feed reeved material into the well bore as the well string is formed and lowered thereinto, it can be appreciated that the reel means supporting the reeved material preferably starts its rotation as the well string is lowered, and stops its rotation when the well string is stopped to enable another tubular joint or tubular joints to be connected thereinto. Heretofore, some problems have been encountered in properly initiating rotation of the reel means in conjunction with lowering of the connected tubular joints into the well bore and in stopping rotation of the reel means when the lowering of the well string is stopped.

The problem may be further complicated in that the initial or beginning rate of lowering of the well string by the driller may be quite sudden and may be so sudden as to cause parting or breaking of the reeved material or otherwise damaging such reeved material. Additionally, if the reeved material breaks, and if rotation of the reel means has been initiated prior to such break, then additional time and effort is lost not only in stopping the continued rotation of the reel means, but in effecting a reconnection of the broken reeved material in a manner that is satisfactory. In addition, the rate of lowering of the well string may vary during the downward movement of the well string and it is difficult to correlate the rotation of the reel means with the rate, and changing rate of movement of the well string as it is lowered.

Also, rotation of the reel means creates a flywheel effect, and in some instances it may be extremely difficult, if not substantially impossible, to stop rotation of the reel means when lowering of the well string is stopped so that the reel means continues to rotate and pays out the reeved material which either falls on the earth adjacent the well bore, or may fall into the well bore and cause either partial clogging of the well bore or entanglement of the reeved means either in the well bore or on the earth's surface.

The same general problems are encountered when the well string with material is removed from the well bore.

A primary object of the present invention is to overcome the above and other problems and objections encountered with simultaneously moving reeved material into, or removing it from, a wall bore with another member such as a well string.

Yet a further object of the invention is to provide a method and apparatus for stepwise lowering into or removing from a well bore material supported on reel means in conjunction with the stepwise lowering of a well string into, or its removal from, a well bore so that movement of the reeved material into, or its removal from, a well bore is coordinated with either the lowering of the well string into or its removal from a well bore, such coordination also being in relation to either stopping such lowering, or stopping such removing of the well string, to enable another tubular joint, or joints, to be connected thereinto, or disconnected therefrom and without rotating the reel means during movement of the material and well string into or the removal thereof from a well bore.

Another object of the present invention is to provide a method and apparatus for moving reeled material into or removing it from a well bore upper end in the earth's surface, which reeled material is supported and moved into and out of the well bore in a manner to inhibit the flywheel effect associated with rotating reel means.

Still another object of the present invention is to provide a method and apparatus for stepwise lowering into or removing from a well bore material supported on reel means in conjunction with the stepwise lowering of a well string into, or its removal from, a well bore so that movement of the reeved material into, or its removal from, a well bore is coordinated with either the lowering of the well string into, or its removal from a well bore without rotating the reel means during movement of the material and well string into or removing it from a well bore.

Other objects and advantages of the present invention will become apparent from a consideration of the following description and drawings.

DESCRIPTION OF THE PREFERRED EMBODIMENTS

Figure 1:
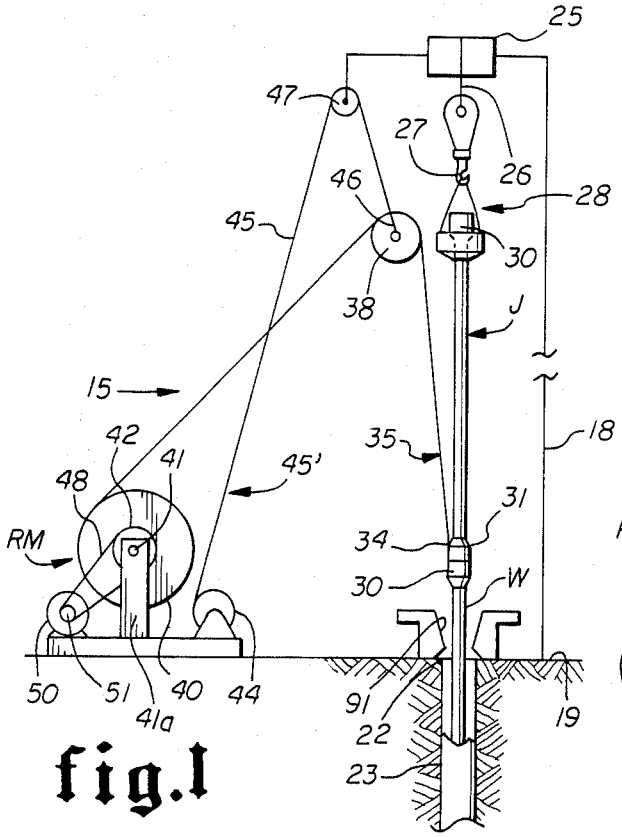
FIG. 1 is a schematic view illustrating a diagrammatic arrangement of a portion of the apparatus of the present invention whereby the well string and reeled material may be simultaneously moved into the well bore.

Attention is first directed to FIG. 1 of the drawings wherein a portion of the apparatus of the present invention is schematically illustrated and is referred to generally by the numeral 15. Such apparatus includes support means including an upright member 18 which may be a drilling or workover mast or any other suitable arrangement that may be positioned on the earth's surface 19 adjacent the upper end 22 of a well bore illustrated at 23. The upright member 18, as previously noted, is constructed in any suitable manner and form well known to those skilled in the art. It supports a crown block 25, the details of which are well known to those skilled in the art, or any other suitable means, which include a cable 26 depending therefrom on which are carried suitable means 27 for connecting with engaging means schematically illustrated and referred to generally at 28.

Such engaging means may be in the form of elevators referred to generally at 28, the structural details of which are well known to those skilled in the art and are constructed and arranged to engage a tubular joint as represented generally by the letter J adjacent the upper enlarged end, or box end 30 thereof, which box end is provided with threads internally in a manner well known to those skilled in the art to enable the pin end 31 of another tubular joint to be threadedly engaged therewith as will be described. As shown in FIG. 1, the lower end, or pin end 31 of the tubular member J is shown as being threadedly connected into the box end of the next lower tubular joint of well string W which is formed of a plurality of tubular joints connected in end-to-end relation and extends into the well bore 23. The tubular joint J may be a single tubular joint, or a "stand" of pipe or tubular members may be formed by connecting a plurality of tubular joints together and stepwise connecting the "stands" or single tubular joint together to form the well string W and stepwise lowering each "stand" or single tubular joint, which then becomes part of the well string W in the well bore 23.

Where reeved material, identified as RM, that is material supported on reel means such reeled material being, for example, cable, electric or fluid conductor is to be simultaneously lowered into the well bore as the well string W is formed and lowered into the well, the end 34 of the reeved material referred to generally by the letters RM which is reeved on the reel means 40 is connected to the well string W at any desired position thereon. If it is desired that the reeved material RM extend throughout the longitudinal extent of the well string W, then the tubular joint J illustrated in FIG. 1 will be the first section of the well string W to be lowered into the well bore 23 and will comprise the lowermost end of the well string W. In such event, the end of the reeved material RM is connected as represented at 34 to the lowermost end portion of the well string W. The end of material RM is secured to the well string W by any of several different means known to those skilled in the art.

It is preferable that the reeved material RM be continuous throughout its longitudinal extent in the well bore. The present invention enables a continuous strand of reeved material to be fed into the well bore with a minimum of effort and trouble and generally speaking, without regard to the initial rate of lowering of the tubular joint J, or variations in rate of lowering of the tubular joint J from its elevated position shown in FIG. 1 to its lowermost position illustrated in FIG. 2 of the drawings.

It is to be noted that the portion of the reeved material RM extending between the reel means 40 and the connection of the end 34 of such reeved material RM is referred to generally by the numeral 35. The portion 35 or unreeved material between the reel 40 and its connection 34 to the well string is supported in an elevated manner by movable means such as movable pulley means 38 as shown in the drawings.

Second support means referred to generally by the numeral 45′ includes pulley cable means 45 which has one end connected by any suitable means as illustrated at 46 to the movable pulley means 38 to enable the movable pulley means 38 to rotate freely. The cable means 45 also forms part of the means which accommodates lowering of the pulley means 38 relative to the upper end 22 of the well bore as some of the portion 35 of the reeled material is pulled into the upper end 22 of the well bore 23 when the well string W and the tubular joint J are lowered into the well bore 23.

Additional pulley means 47 are supported by the upright means or member 18 in fixed position above the movable pulley means 38 as illustrated in FIG. 1 of the drawing and the cable means 45 extends from the drum means represented at 44 on which it is wound over the fixed pulley means 47 with the end 46 of the cable means 45 connected to the movable pulley means 38 as previously noted. The arrangement and relationship of the additional pulley means 47 to the movable pulley means 38 enables the movable pulley means to assume, when desired, a predetermined elevated position in relation to the upper end 22 of well bore 23.

As better illustrated in FIG. 5, restraining means referred to generally by the numeral 47' are provided for restraining rotation of the drum 44 and downward movement of the pulley means 38 for a purpose and in a manner as will be described in greater detail hereinafter. The restraining means 47' includes rotary disc means **47*b* mounted on rotatable shaft 74 on which drum 44 is supported for rotation. Disc brake pad means are schematically represented at 47*a* which may be actuated to frictionally clamp against or engage disc 47*b* to restrain or lock drum 44 against rotation. The drum restraining means also includes means referred to generally at 60** to release the drum restraining means when desired.

Actuating means referred to generally at 80 is operatively associated with said pulley support means 45' for raising the pulley means 38 relative to the upper end 22 of the well bore 23 along with the unreeled material portion 35 supported thereby, as will be described in greater detail. However, when the pulley means 38 is moved by the pulley support means 45' and actuating means referred to generally at 80 from the lowered position diagrammatically illustrated in FIG. 2 to its upper or raised position, as illustrated in FIG. 1, the brake means 56 is released to enable the reel means 40 to rotate and pay out additional unreeled material portion 35 from the drum means 40 to provide an additional portion of unreeved material referred to generally by the numeral **35*a* in FIG. 3** of the drawings, as will be further described and explained.

The reel means 40 is supported for rotation to enable the reeved material to be paid out therefrom and to be reeved thereon, but suitable reel restraining means referred to generally at 56 are provided to inhibit or prevent rotation of the reel means except when it is desired.

Figure 7:
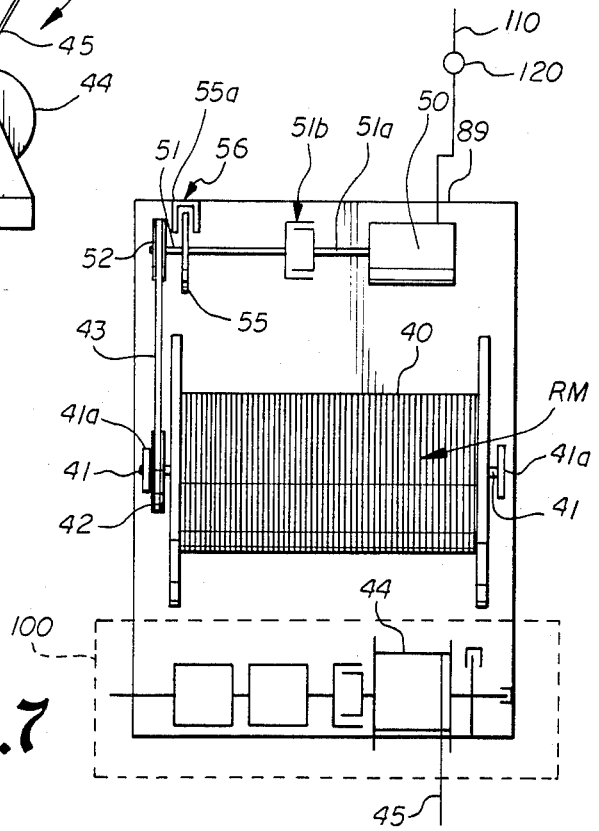
FIG. 7 is an additional schematic view illustrating one arrangement of the components shown in FIGS. 5 and 6.

For example, in FIG. 7 the reel means 40 is again illustrated with the material reeved thereon and designated by the letters RM in plan view. An air motor 50 is provided with a shaft **51*a* as shown. An extension shaft 51 is supported for rotation and is provided with a sprocket represented at 52. The rotatable motor shaft 51*a* and shaft extension 51 are interconnected by any suitable clutch means represented at 51*b*. When clutch 51*b* is engaged, shafts 51*a* and 51 are connected to be rotated simultaneously by motor 50 and rotate sprocket 52**.

Similarly, the shaft 41 which supports the reel means 40 for rotation on support means **41*a* is diagrammatically illustrated and shaft 41 also has mounted thereon a sprocket 42. A continuous chain 43 extends between the sprockets 52 and 42 so that when the air motor 50 is actuated and clutch means 51*b* to connect motor shaft 51*a* and shaft 51, rotation of the reel means 40 is effected. Any suitable means may be employed to restrain or inhibit rotation of the reel means 40 as a portion of the reeled material is pulled into the upper end 22 of the well bore 23. In FIG. 7, one suitable arrangement is diagrammatically illustrated generally at 56 and includes brake disc means 55 carried by the rotatable shaft 51, which is engageable by the disc brake pad means schematically shown at 55*a* to restrain rotation of the shaft 51 as well as reel means 40 since it is interconnected with shaft 51 through the shaft 41 on which reel means 40 is supported and through the chain drive connection 43 between sprockets 42 and 52**.

Figure 5:
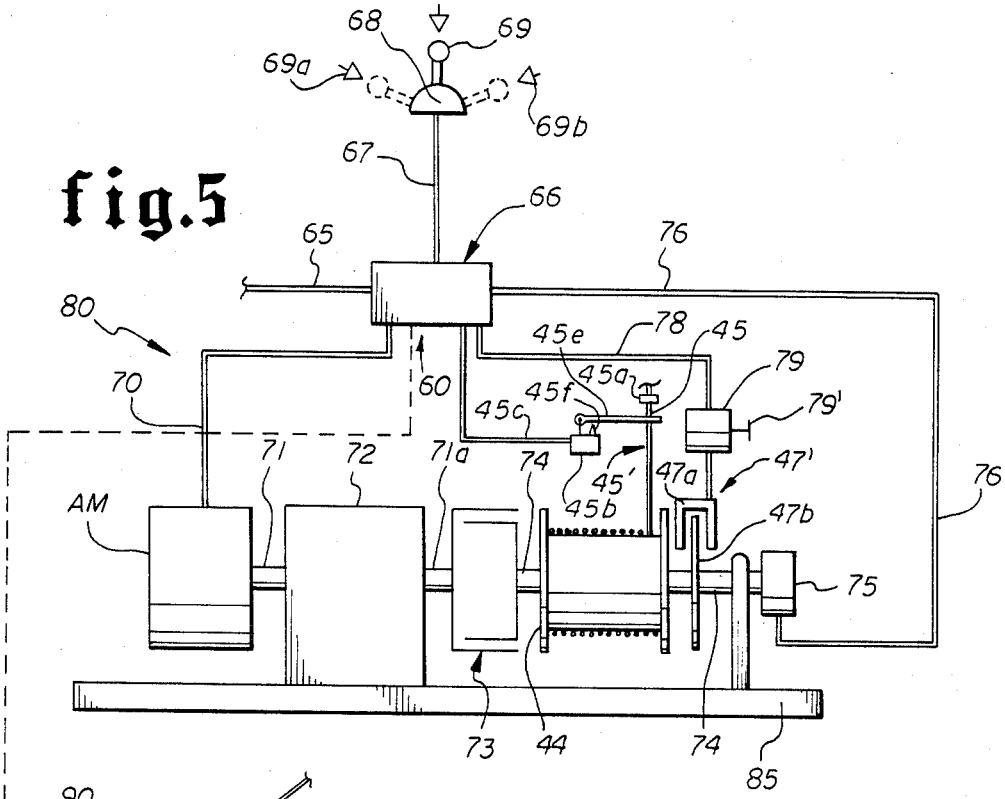
FIG. 5 is a schematic view illustrating an arrangement of the actuating means associated with the present invention.

One form of the actuating means 80 is diagrammatically illustrated in FIG. 5 of the drawings and is shown as being actuated from an air or pneumatic supply source represented at 65. It can be appreciated that any suitable pneumatic, hydraulic or electrical means may be readily employed to supply power to accomplish the desired results of the present invention. The invention will be described in detail where pneumatic power source is employed, and such is by way of example only. Control valve means referred to generally at 66 are connected with the air supply source 65 as shown in FIG. 5. A control conduit 67 is connected with a control throttle lever support means 68 whereby the flow of air from source 65 to the air relay and control valve 66 is monitored and controlled to effect actuation of the actuating means referred to generally at 80 in a manner as desired. It will be noted that a conduit 70 connects control valve 66 with a reversible air motor represented at AM, the shaft 71 of which connects with the gear reduction means 72. An air clutch represented generally at 73 of well known construction and design is supported on rotatable shaft **71*a* extending from gear reduction means 72 and is actuated by air through the hollow shaft 74 which is provided with any suitable rotary seal swivel represented at 75 and hollow shaft 74 to actuate the air clutch in a manner well known in the art. Rotation of air motor AM is thus transmitted through shaft 71, gear reduction means 72, shaft 71*a*, engaged air clutch 73 and shaft 74 to rotate drum 44**.

For example, when the control lever 69 of control lever support 68 is moved to the dotted line position shown at **69*a*, air is transmitted through control valve 66 and conduit 70 to air motor AM and is also transmitted through conduit 76, rotary seal swivel 75 and shaft 74 to actuate air clutch 73 and engage it with shaft 71*a* so that drum 44 may be rotated to unreel cable 45 when desired, so that pulley means 38** is thus lowered by power.

It will be noted that conduit 78 is connected to air relay control 66 and that an air pressure regulator is provided in the conduit 78 as represented at 79. The means 47 for restraining rotation of the drum 44 may be of any suitable form and includes air disc brake pads **47*a*, as represented in FIG. 5, which engage with disc means 47*b* mounted on rotatable shaft 74 which restrains rotation of shaft 74 and drum 44 carried on such shaft and in turn restrains rotation of drum 44. However, when the lever 69 is in position 69*a*, flow of air through conduit 78 is prevented, and this releases means 47' so that drum 44 may rotate and power pulley means 38** downwardly.

When the control lever 69 is in the upright full line position illustrated in FIG. 5 of the drawings, flow of air through conduit 70 is shut off and thus air motor AM is off. Also, flow of air through conduit 76 is shut off and thus air clutch 73 is not activated and therefore shafts **71*a* and 74 are not operatively engaged to rotate together. Also, when 69 is in the full line position air is supplied through conduit 78 to act through air pressure regulator 79 on the brake pads 47*a* so as to urge them into dragging relationship with disc 47*b*. This restrains freewheeling of drum 44 and prevents unrestricted pay out of cable 45'. Therefore, when lever 69 is in the full line position shown, cable means 45' can unreel from drum 44 so that movable pulley means may move downwardly. The rate of such downward movement is restrained by the means 47' as described. Also, air is supplied from control valve 66 through the conduit represented at 90 to actuate disc pads 55***a* against disc 55 and lock reel means 40 against rotation. Thus, the downward movement of movable pulley means 38 from its position shown in FIG. 1 to the position shown in FIG. 2 is somewhat restrained and this maintains the portion 35 of the unreeled material RM taut between the reel means 40 and the connection 34 with the joint J of the well string W as the pulley means 38 is lowered or pulled downwardly when the well string is lowered into the well bore 23 which also pulls on portion 35 of the unreeved material to pull some of it into the well bore 23 as the well string W is lowered.

Figure 2:
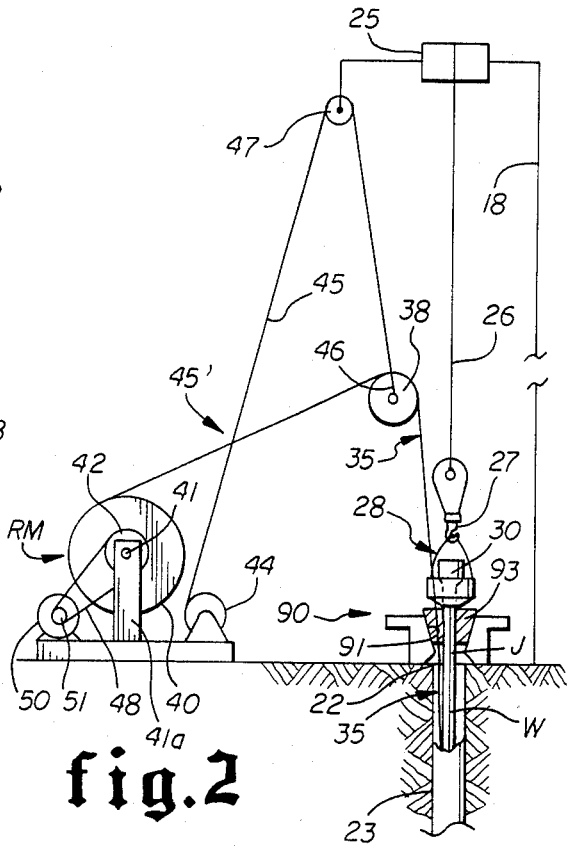
FIG. 2 is a diagrammatic representation similar to FIG. 1 and illustrating the relationship of the components of FIG. 1 when the tubular joint of the well string has been lowered from the position of FIG. 1 to the position illustrated in FIG. 2.

By way of further explanation, when it is desired to lower the joint J from the position shown in FIG. 1 to the position shown in FIG. 2 so as to simultaneously pull or move some of the portion 35 of the unreeled material RM into the well bore simultaneously with and in relation to movement downward of the well joint J by the elevator means 28, control lever 69 is moved to solid line position so that air flow in the actuating means 80 locks the reel means 40 against rotation by the brake means 56 engaging disc means 55 on shaft 51 which prevents rotation of the reel means 40 as above described. Similarly, the control lever 69, when in the solid line upright position illustrated in FIG. 5, disengages air clutch 73 and air motor AM is inoperative. However, air is supplied through conduit 78 whereby the brake means 47' acts as a drag to restrain rotation of drum means 44 and hence restricts paying out of cable means 45 and downward movement of movable pulley means 38.

Since the lower end of the portion 35 of unreeled material RM is connected at 34 to the joint J of well string W lowering of the well string W and joint J by the means 25, 26 and 27 pulls some of the portion 35 of the unreeled material RM into the well bore simultaneously with lowering of the joint J. Further, the rate of movement of the portion 35 into the well bore is not only in relation to the rate of lowering of the Joint J, but it is in relation to any change in the rate of lowering during lowering of the tubular joint J from the upright position above the upper end 22 of the well bore 23 to the lower position of joint J represented in FIG. 2.

Figure 3:
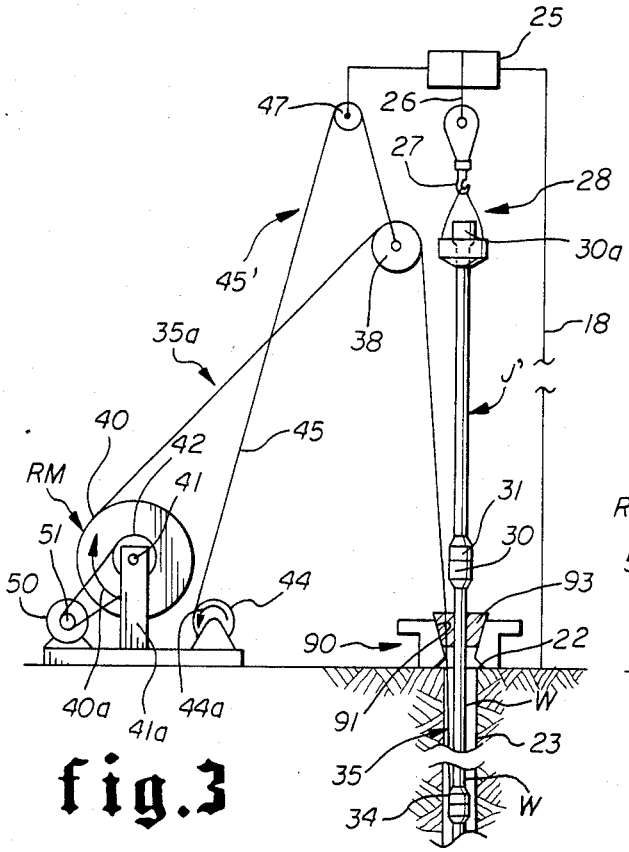
FIG. 3 is a view similar to FIGS. 1 and 2 and diagrammatically represents the relationship of the components when an additional tubular joint is connected into the well string with the movable pulley means raised to its elevated position and the reel means unlocked to enable additional reeled material to be paid out as the pulley means is raised to the position illustrated in FIG. 3.

The tubular joint J support and holding means referred to generally at 90 are provided to hold the lowered tubular joint J adjacent the upper end 22 of the well bore 23 as diagrammatically illustrated in FIGS. 2 and 3 to enable another tubular joint represented at J' in FIG. 3 to be connected therewith. The tubular joint support and holding means 90 includes slip bowl means 91 of a well known configuration and arrangement which is mounted in a manner well known to those skilled in the art adjacent the upper end 22 of the well bore 23. Slip means 93 are provided for positioning in the slip bowl to engage adjacent the upper end of the tubular joint J and to expose and support it above the well bore upper end 22 whereby the tubular joint J' may be engaged therewith. After the support means including means 25, cable means 26, hook means 27 and elevator means 28 have operated or been actuated to lower the tubular joint J from the position represented in FIG. 1 to the lower position shown in FIG. 2, then the slips 93 are positioned in the slip bowl 91 to hold the box end 30 thereof exposed above the upper end 22 of the well bore.

A tubular joint J' or stand of tubular joints is moved to elevated position and supported adjacent upright 18 as shown. In some instances, the additional tubular joint J' or stand of tubular joints J' will be elevated from a pipe rack or the like to the upright position. In other instances, the joints J' will be initially positioned and supported in upright position adjacent the upright 18. If the support means is employed to elevate the joint J' to the upright position, such tubular joint J' is engaged by the elevator means 28 in a manner well known in the art and is then raised relative to the upright member 18 and supported in the position illustrated in FIG. 3 of the drawings.

Either before, during or after the tubular joint J' is in elevated position and its lower pin end 31 connected with the upper box end 30 of the tubular joint J, the pulley means 38 and the pulley support means 45, as well as the reel release means 56 which releases the reel restraining means and the restraining means 47' acting on drum means 44 is actuated to enable the movable pulley means 38 to move from the FIG. 2 position up to the position shown in FIG. 3.

For example, when lever 69 is moved to dotted line position 69*b* air flow through 90 is cut off and the pressure released from conduit 90 to release the brake means 56 so that reel means 40 is free to rotate. Also, when lever 69 is in position 69*b*, air flow through 78 is cut off and released so drum restraining means 47' is disengaged; air through conduit 70 actuates air motor AM and air through conduit 76 actuates clutch 73 to engage rotatable shafts 71 and 74 whereby rotation of drum 44 by air motor AM is effected. The rotation of drum 44 is in the direction represented by the arrow 44*a* in FIG. 3 which raises pulley 38 from the lower position shown in FIG. 2 to its initial elevated position similar to that in FIG. 1 as well as being shown in FIG. 3. The end of material RM connected to the well string W is lowered, or pulled in the well bore 23 when joint J is lowered as shown and described with regard to FIGS. 1 and 2. Raising of the movable pulley means 38 by the rotation of drum 44 in the direction represented at 44*a* causes the reel means 40 to rotate in the direction represented by the arrow 40*a* in FIG. 3. The power of air motor AM and rate of rotation of drum 44 is relatively low so that sufficient pull is exerted on the unreeved material portion 35*a* to rotate reel means 40 and thereby unreel additional material RM therefrom as the pulley means 38 moves up from its position shown in FIG. 2 to the position shown in FIG. 3, which additional material is supported by pulley means 38 as shown in FIG. 3.

Since the rate of rotation of motor AM is slow, or at least at a sufficient rate so as to not impart a sudden jerk or sudden pulling effort on the cable portion 35*a* shown in FIG. 3 of the drawings, the large reel means 40 will rotate slowly. Since the heavy, large reel means 40 is rotated slowly by the raising of the pulley means 38 with the air motor AM and drum 44, any flywheel effect that might otherwise be created by the rotation and continued rotation of drum 40 is substantially reduced if not completely eliminated. Similarly, since the reel means 40 is rotating slowly and ordinarily is of substantial size and weight, it is stopped easily by brake means generally at 56 when the movable pulley means 38 reaches the elevated position shown in FIG. 3 as well as in FIG. 1.

Figure 4:
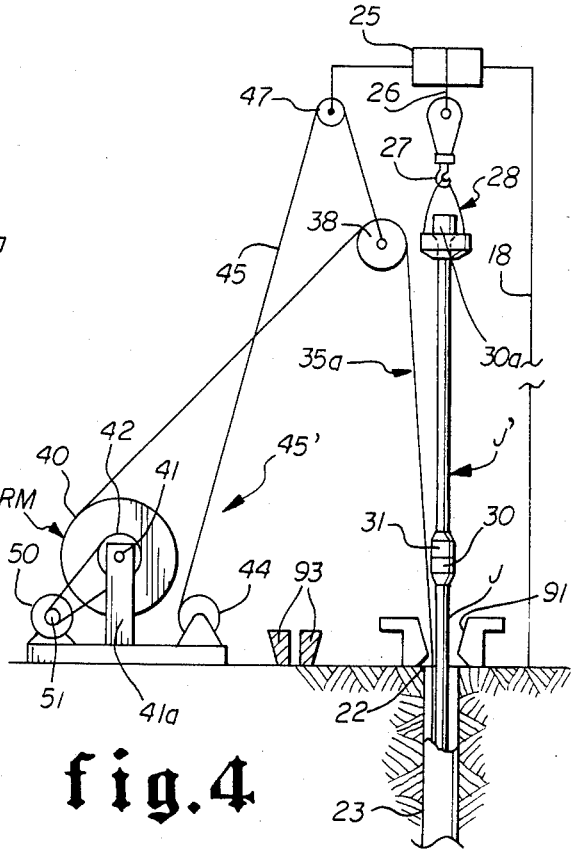
FIG. 4 is a diagrammatic representation similar to the foregoing figures and illustrates the relationship of the components when it is desired to move or lower the well string into the well bore.

Since an additional portion of reel material RM has been pulled off the reel 40, this additional material is represented by the numeral 35*a* in FIG. 3. Thereupon, lever 69 is moved to the solid line position and air flow in actuating means 80 is such that clutch 73 is disengaged; air motor AM is deactivated; restraining means 47' and 56 are respectively engaged. Thus, drum means 44 is restrained while it rotates and reel means 40 is locked against rotation. The lowering operation of elevator means 28 and the newly added tubular joint or stand of tubular joints represented at J' in FIGS. 3 and 4 is ready to be initiated. The slips 93 are removed from the slip bowl 91 as represented diagrammatically in FIG. 4, whereupon the elevator means 28 and joint J' may be lowered by the means 25, 26, 27 in a manner as previously described until the joint J' then assumes the position with its upper end 30*a* assuming an exposed position adjacent the upper end of the well bore 22 as described with regard to FIGS. 1 and 2. The slips 93 may then be reinserted into the slip bowl 91 so as to hold the lowered tubular joint or stand of tubular joints J' in the relative position of tubular joint J as illustrated in FIG. 2 of the drawings so that still another joint may be connected in the well string W. The slips 93 are separated circumferentially so that the material 35 extending between the slips and into the well bore will not be damaged.

This operation is continued until the desired amount of well pipe has been lowered into the well bore along with the desired continuous strand or extent of reeved material RM. The reeved material may be conduit such as spaghetti tubing, electrical conduit, cable means or any other continuous reeved material which it is desired to move into the well bore.

Figure 6:
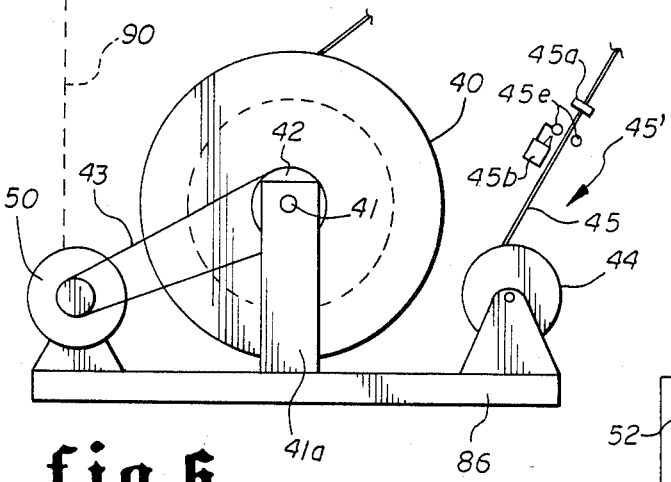
FIG. 6 is a further schematic view illustrating means to effect rotation of the reel means when desired.

FIG. 7 combines the components carried on the skid 85, shown in FIG. 5, with the components carried on the skid 86 shown in FIG. 6. In such situation the skid 89 of FIG. 7 is a single platform as illustrated. However, in some circumstances it will be desirable to separate the two skids 85 and 86 so that portions of skid 85 encompassed within the dotted line rectangle as illustrated at 100 may be positioned at any desired location in relation to the well bore 23 as desired. Also, in some circumstances, it may be desirable to locate the components mounted on skid 86 in a more remote location relative to the well bore 23 and upright member 18.

The present invention also contemplates method and apparatus for simultaneously removing the well string W and material RM connected therewith from the well bore.

Figure 8:
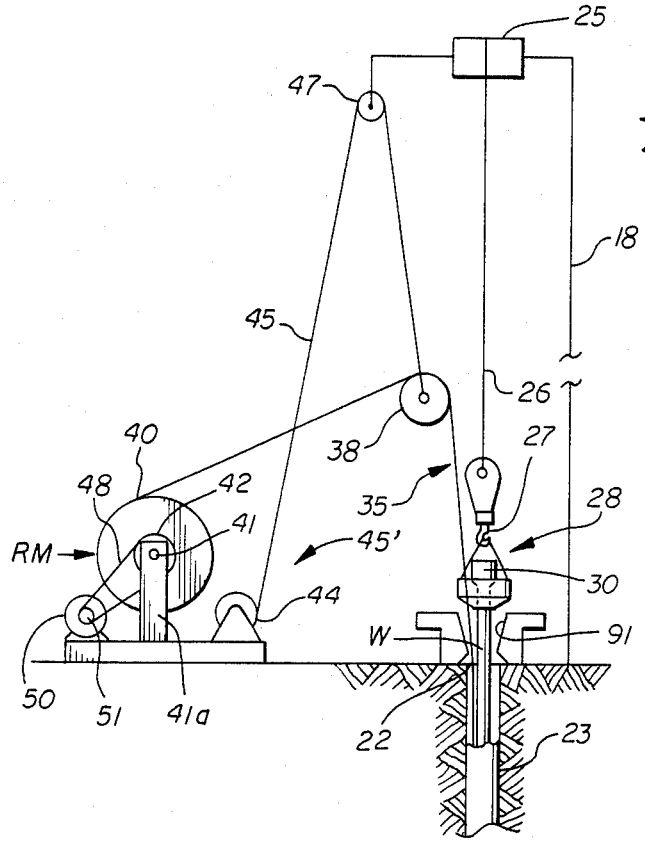
FIG. 8 is a schematic view similar to FIGS. 1–4, and showing the relationship of the components when the well string is to be pulled from the well bore.
Figure 9:
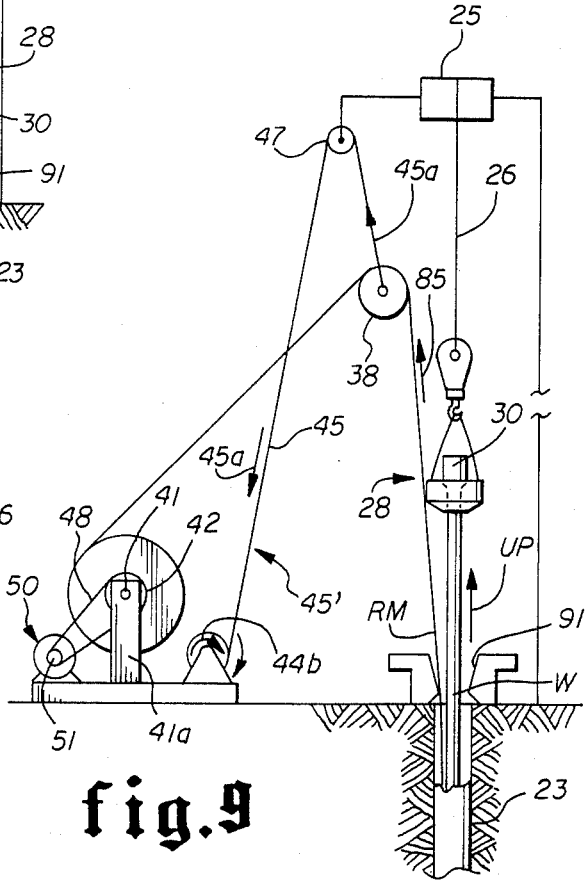
FIG. 9 illustrates the relationship of the components as the well string is being pulled from the well bore.

In FIGS. 8–12, like numerals refer to like components of FIGS. 1–7, inclusive. In FIG. 8 the movable pulley means 38 is shown in its lowered position and again supporting the portion 35 of material RM extending between reel means 40 on which it is carried and its connection 34 with the well string W. It can be appreciated that the end of the material RM and its connection 34 may be many thousands of feet in the well bore 23, depending on where it is connected to the well string W.

If it is desired, for any reason, to remove all or any portion of the well string W from the well bore 23, the material RM should be simultaneously removed and handled in a manner to prevent damage thereto and reeved on reel means 40. This operation should be conducted in a manner so that the flywheel effect of rotating reel means 40 is reduced, if not completely eliminated.

Also, the rate of removal of material RM should correlate with the rate of removal of well string W, including the starting and stopping rate of the well string W as well as variations in such rate during removal. This invention accomplishes this result.

When pipe is being removed from the well bore, the control lever is placed in position 69*b*. Air is thus supplied to actuating means 80 of FIGS. 5 and 6 so that air through conduit 76 and hollow shaft 74 engages clutch means 73; air through conduit 70 so that air motor AM, and shaft 71 are rotated as is shaft 71*a* from gear reduction means 72. This imparts rotation to drum means 44 so that it rotates in the direction represented by arrow 44*b* in FIG. 9. Air supply is shut off to conduit 78 and the pressure therein released so that restraining means 47' have no affect on drum means 44. The rotation of drum means 44 as described pulls on cable means 45 and reeves it on drum means 44 as the well string W is pulled up by means 25–28, inclusive, in the direction represented by arrow UP in FIG. 9.

The movement of the cable means 45 in the direction represented by arrows 45*a* pulls material RM from the well bore 23 in the direction represented by arrow 85 as the well string W is also pulled upwardly therefrom by the means 25–28, inclusive. It will be noted that the pulley means 38 is elevated from its lowered position illustrated in FIG. 8 towards its elevated position represented in FIG. 10, as the material RM is pulled from the well bore by the pulley means 38. Preferably during this movement, reel means 40 is restrained against rotation by air from 66 acting through conduit 90 to close or move pads 55*a* against disc 55 to lock reel means 40 against rotation.

Figure 10:
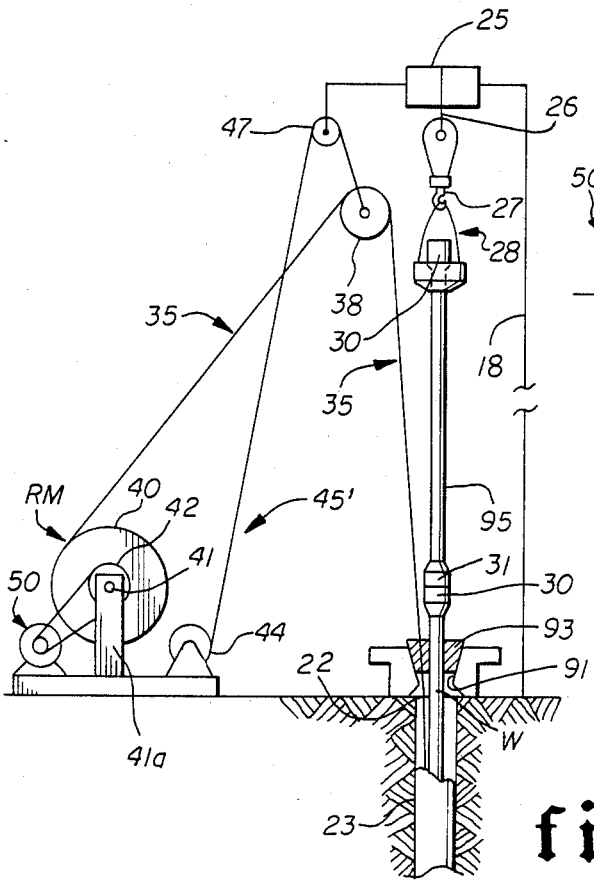
FIG. 10 shows the component relationship when a joint or stand of pipe has been removed from the well bore and is supported at the top of the well bore.
Figure 11:
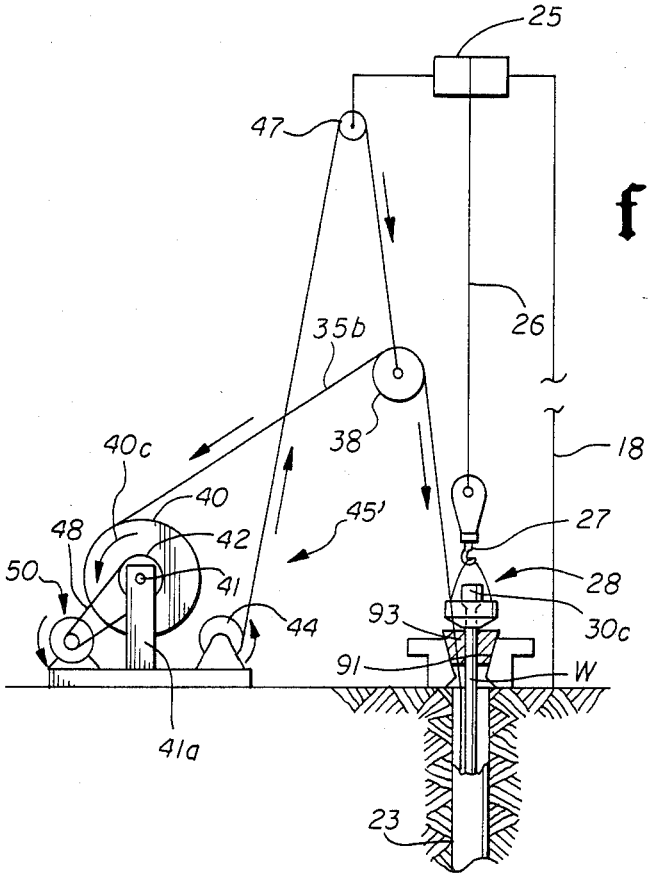
FIG. 11 illustrates the component relationship as the material pulled from the well bore is reeved onto its reel means which also moves the movable pulley means downwardly to its lower position so that the next portion of material will be properly retrieved from the well bore when the next joint or stand of pipe is removed from the well bore.

The movement of drum means 44 and upward movement of pulley means 38 and material RM supported thereby is continued until the joint or stand of pipe represented at 95 in FIG. 10 is removed from the well bore with the lower end thereof exposed above the well bore upper end 22 and above slip bowl 91 as illustrated in FIG. 10. At such time, rotation of drum means 44 ceases and cable means 45 is static as is the portion 35 of material RM extending between the well bore upper end 22 and the reel means 40.

The slip means 93 is set in slip bowl 91 and the pulled joint or stand of pipe 95 may be disconnected from the well string by means and methods well known to those skilled in the art.

Control lever 69 may be placed in the full line, upright position so that clutch 73 is disengaged; air motor AM is shut off; restraining means 47' is actuated to restrain rotation of drum means 44; and air through 90 shut off and released so that restraining means 56 on reel means 40 is deactivated. Clutch means 51*b* is actuated so that shafts 51 and 51*a* are rotatably connected. Air from a suitable source is supplied through line 110 and valve 120 to rotate air motor 50 and connected shafts 51*a* and 51. This rotates reel means 40 in the direction represented by arrow 40*c* in FIG. 11 and exerts a pull on material portion 35*b*, supported on movable means 38, extending from the reel 40 to the connection 34 on well string W in the well bore.

Figure 12:
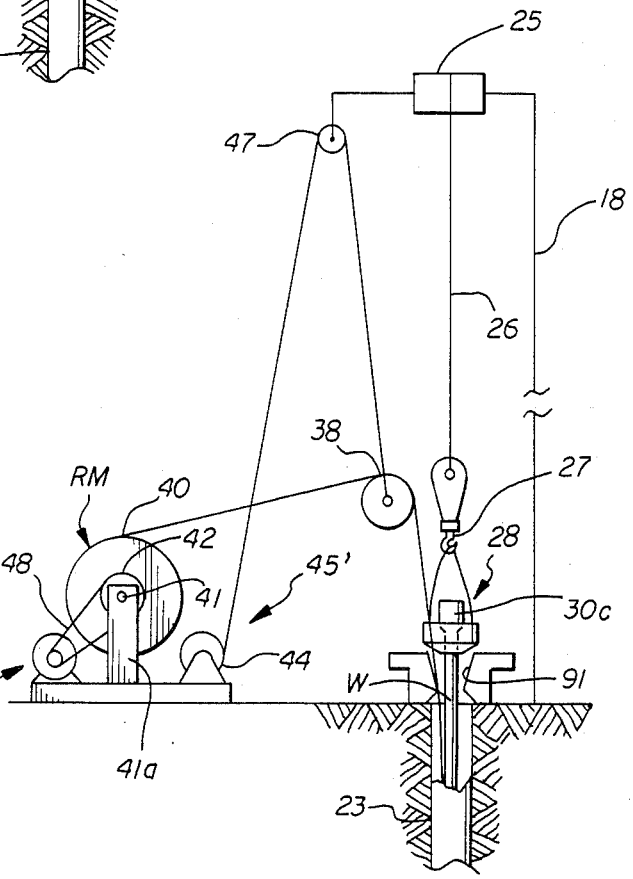
FIG. 12 is a view similar to FIG. 8 and shows the components in relationship ready to retrieve the material from the well bore as the next section of well string W is removed therefrom.

As reel means 40 rotates, the pull on material portion 35*b* forces pulley means 38 downward until it resumes its lowered position illustrated in FIG. 12. As the pulley means 38 is pulled downwardly, some of the portion 35*b* of material RM is reeved on reel means 40, and the cable 45 unreels in response to the forced downward movement of pulley means 38 carried thereby. The drag means 47' will maintain the portion 35*b* of material RM taut as lowering of pulley means 38 and unreeling of cable means 45 is accomplished by reeving some portion of material 35*b* on reel means 40. When this has been accomplished, air is cut off by valve 120 and released from conduit 110. The clutch means 51*b* is deactivated and brake means 56 set by air through conduit 90.

The elevator means 28 is engaged with the box end 30*c* of the next well string section to be removed; slips 93 are removed from slip bowl 91 and the next section of well string is pulled from the well bore 23 as previously described. Control lever 69 is again simultaneously set in position 69*b* to raise pulley means 38 and pull material from the well bore as the well string is removed therefrom. Also, cable 35 is thereby reeved on drum means 44 when the lower end of the removed section is exposed above slip bowl 91 so that slips 93 may be placed therein, the upwardly extending well string section is then disconnected by means well known in the art from well string W as the remainder of the well string W is supported by slips 93 in bowl 91.

Brake means 56 is released; clutch means 51*b* actuated; and air motor 50 actuated to rotate reel means 40 and reeve some of the next portion of material RM removed, or pulled from the well bore on to reel means 40, and this again pulls pulley means 38 down to its lower position, so that the next material section can be removed from the well bore when the next well string section is removed. All of the foregoing may be done simultaneously as the well string is removed; then the pulley means 38 elevated; and the reel means 40 actuated to reeve the material thereon and move pulley means 38 downwardly as described.

These operations are repeated until the desired extent, or all the well string and material RM have been removed from the well bore.

The lowering of the material RM from its reel means 40 into the well bore and its removal from the well bore is accomplished while the reel means 40 is locked against rotation which substantially overcomes, if not completely eliminates. The flywheel effect of handling reeled material which arises in prior art practice in attempting to insert it in or remove it from a well bore along with a well string. As a practical matter, the disc brake means shown generally at 47' is initially set so that the material RM is pulled into and removed from the well bore and adjusts to the initial acceleration of lowering or pulling the well string and any changes in rate of movement which may occur during either operation.

For example, the regulator 70 may be preset by means 79', represented in FIG. 5. When the lever 69 is in the full line position, the air regulator 79 is manually set by adjustment 79' so that pulley means 38 will not move up or down. Then lever 69 is moved to position 69*b* so that actuating means 80 exerts a pull on pulley means 38. Lever 69 is then moved from position 69*b* to full line position 69 and pulley means should stop its upward movement. If pulley means 38 moves down at such time, the drag means 47' is not set tight enough and it should be adjusted so that more air pressure acts through regulator 79 to exert a greater action by pads 47*a* on disc 47*b*.

Then, a manual pull should be exerted on material portion RM supported by pulley means 38, when pulley means is in stopped position and if pulley means 38 moves down in response to such manual force, regulator 79 should be adjusted to enable pads 47*a* to move grip disc 47*b* with slightly more force.

The foregoing is repeated until a manual pull on material RM cannot move pulley 38 down. This will enable the material RM and the components of the present invention to function so that the material RM adjusts to the initial acceleration and deceleration of the well string and any changes in the rate of movement during lowering or removing of the well string W from the well bore.

When problems in the well bore, or the surface, require that the movable pulley 38 be moved down, the lever 69 is moved to position 69*a* which powers the pulley means and material RM supported thereby down as previously described. This operation may be employed to lower pulley means 38 to enable the end 34 of material RM to be secured to the well string W. Also, this procedure may be employed to inspect the pulley means 38 or to place slack in the portion 35 of material RM.

The air motor AM has an air regulator associated therewith in a manner well known to those skilled in the art so that a desired amount of tension is applied to the portion 35 to raise, but not overpull portion 35 as it is removed from the well bore. Further, the air motor AM is always capable of pulling material RM from the well bore faster than the rate of pipe withdrawal can be accomplished. As a practical matter, actuating means 80, as can be seen from the foregoing description only releases brake 56 acting on reel means 40 when paying out material RM to be thereafter pulled into the well bore, or when material RM is being reeved onto reel means 40 as it is pulled from the well bore.

The clutch means 51*b* may be a manually connected coupling shaft, by way of example only.

If desired control valve 66 may employ a magnetic hold down so that it can be manually moved adjacent valve means 120 during operations where valve 120 is employed.

The means to deactivate the actuating means 80 may assume any form and one embodiment is schematically illustrated in FIGS. 5 and 6.

A pair or rods 45*e* are pivotally mounted on vent valve 45*b* and project therefrom as illustrated. Cable 45 extends between rods 45*e*, as shown, and when means 45*a* clamped on cable meas 45 is lowered to engage rods 45*e*, they pivot down to engage projection 45*f* and actuate valve 45*b* to vent it to atmosphere. At this time, valve 45*b* also communicates conduit 45*c*, connected to control valve 66, to atmosphere so that control valve 66 is thus returned to neutral position which deactivates and stops the further upward movement of movable means 38 when it reaches its desired elevated position.

It can be appreciated that means 45*a* may be adjustably positioned at any desired position on cable means 45. Also, the valve 66 is automatically repositioned for the next cycle by the foregoing operation.

The foregoing disclosure and description of the invention are illustrative and explanatory thereof, and various changes in the size, shape and materials as well as in the details of the illustrated construction may be made without departing from the spirit of the invention.

What is claimed is:

1. Apparatus for running a well string composed of tubular joints into the upper end of a well bore in the earth's surface while simultaneously lowering material connected to the well string into the upper end of the well bore including:

a. engaging means engageable with a tubular joint to lower it into the well bore;

b. first support means connected to said engaging means to lower said engaging means relative to the well bore upper end;

c. reel means on which the material is reeved;

d. movable means supporting the material which extends between its connection to the well string and said reel means; and e. means to enable the material to be pulled into the well bore along with the well string to which it is connected without rotating said reel means on which the material is reeved, said means including: second support means connected to said movable means to position it in elevated position in relation to the well bore upper end and to accommodate lowering of said movable means relative to the well bore upper end as a length of the material is pulled into the well bore upper end when the well string tubular joint is lowered into the well bore by said support means.

2. Apparatus as recited in claim 1 including reel restraining means to restrain rotation of said reel means as the material is pulled into the upper end of the well bore and wherein said movable means includes pulley means.

3. Apparatus of claim 1 wherein said second support means includes:

a. cable means having one end connected to said movable means;

b. additional movable means mounted in fixed position above said movable means and over which said cable means extends; and c. drum means on which said cable means is reeved.

4. Apparatus as recited in claim 3 including restraining means to restrain lowering of said movable means to maintain the material extending between its connection to the well string and said reel means taut as the material is pulled into the well bore.

5. Apparatus as recited in claim 4 including:

a. release means for releasing the restraint on said lowered movable means;

b. actuating means operatively associated with said second support means for raising said lowered movable means relative to the upper end of the well bore along with the material supported thereby; and c. reel release means to release said reel restraining means whereby said reel may rotate and unreel the reeled material as said movable means is raised from its lowered position by said actuating means.

6. Apparatus as recited in claim 5 including means to deactivate said actuating means when said movable means reaches its elevated position.

7. Apparatus as recited in claim 6 wherein the means to deactivate includes:

a. valve means;

b. adjustable means carried by said cable means;

c. actuating means associated with said valve means and engageable by said adjustable means to open said valve means and deactivate said actuating means.

8. Apparatus as recited in claim 5 wherein said restraining means includes brake means to restrain said drum means against rotation and wherein said release means includes means to release said brake means.

9. The apparatus of claim 8 wherein the tubular joint support means includes:

a. slip bowl means adjacent the upper end of the well bore; and b. slip means for said slip bowl means engageable adjacent the upper end of the tubular joint to support it above the well bore upper end whereby another tubular joint may be engaged by said elevator means and supported in upright position for connection with the end of the tubular member supported by said slip means.

10. The apparatus of claim 5 wherein said reel restraining means includes brake means to lock said reel against rotation and wherein said reel release means includes means to release said brake means whereby said reel means is rotated by raising said movable means relative to the upper end of the well bore.

11. Apparatus as recited in claim 5 wherein said actuating means includes:

a. a source of power;

b. power actuated motor means connected with said power source;

c. power actuated clutch means connected with said power source for connection of said drum means with said motor means to rotate said drum means and reeve said cable means on said drum means; and d. control means to control the flow of power from said source to said clutch and motor means for rotation of said drum means by said motor means.

12. Apparatus as recited in claim 11 wherein said restraining and release means includes:

a. power actuated brake means connected with said power source to control rotation of said drum means; and b. control means to control the flow of power from said source to said brake means to selectively actuate and release said brake means to selectively restrain said movable means and to release the restraint on said movable means.

13. Apparatus as recited in claim 12 wherein said brake means includes disc means operatively connected with said drum means, and disc brake pad means connected for operation by said power source.

14. Apparatus as recited in claim 11 wherein said power source is fluid and said motor means, clutch means and brake means are fluid actuated.

15. Apparatus as recited in claim 11 wherein said power is electrical and said motor means, clutch means and brake means are electrically actuated.

16. The apparatus of claim 1 wherein:

said first support means includes upright means for positioning adjacent the upper end of the well bore and extending upwardly relative to the earth's surface;

wherein said engaging means includes elevator means supported on said upright means; and means for lowering said elevator means relative to said upright means and the well bore upper end for lowering the tubular joint and material simultaneously.

17. Apparatus as recited in claim 1 including tubular joint support means to hold the lowered tubular joint adjacent the upper end of the well bore to enable another tubular joint to be connected therewith.

18. Apparatus as recited in claim 1 including reel motor means to rotate said reel means and means to selectively engage and disengage said reel motor means and said reel means.

19. A method of simultaneously lowering a well string formed of a plurality of end-to-end connected tubular joints into the upper end of a well bore along with a portion of material which extends from reel means and which reeled material has one end connected to the well string comprising the steps of:

a. supporting the well string in the well bore in an initial predetermined position with an upright tubular joint thereof extending above the upper end of the well bore;
b. supporting the material portion extending between its connection to the well string and the reel means in a predetermined elevated position relative to the well bore upper end to accommodate downward movement thereof;
c. locking against rotation the reel means which supports the reeled material; and
d. lowering the well string including the upright tubular joint into the well bore to pull into the well a portion of the elevated material and extending between the reel means and the connection thereof with the well string.

20. The method of claim 19 including the steps of:
a. stopping lowering movement of the tubular joint into the well bore so that the upper end thereof is exposed above the well bore upper end;
b. retaining the exposed upper end of the tubular joint above the well bore upper end;
c. unlocking the reel means for rotation;
d. disconnecting the well string support means from the lowered tubular joint and elevating it to its initial position;
e. elevating the material extending between the reel means and well bore upper end to its predetermined elevated position whereby the unlocked reel means rotates to pay out additional reeled material; and
f. engaging another tubular joint with the exposed end of the tubular joint retained adjacent the well bore upper end.

21. A method of simultaneously lowering a well string formed of a plurality of end-to-end connected tubular joints into the upper end of a well bore along with a portion of material which is carried by and extends from reel means with an unreeled end of the reeved material connected to the well string comprising the steps of:
a. supporting the well string in the well bore in initial position with an upright tubular joint thereof extending above the upper end of the well bore;
b. supporting the material portion extending between its connection with the well string and the reel means in a predetermined elevated position relative to the well bore upper end to accommodate downward movement thereof; and
c. lowering the well string and upright tubular joint into the well bore to pull into the well bore a portion of the material supported in an elevated position.

22. A method of moving material into the upper end of a well bore in the earth's surface, which material is reeved on rotatable reel means while inhibiting flywheel effect associated with rotating reel means comprising the steps of:
a. supporting the portion of material which extends between the reel means and the well bore in a elevated position relative to the well bore upper end to accommodate downward movement thereof; and
b. moving a length of the elevated material which extends between the reel means and well bore into the upper end of the well bore until the elevated material is pulled downward relative to the well bore upper end without rotating the reel means on which the material is reeved.

23. The method of claims 21 or 22 including the steps of:
a. restraining the reel means against rotation while the material moves into the well bore; and
b. controlably restraining downward movement of the elevated material to maintain the material extending between its connection to the well string and the reel means taut as the elevated material portion is moved to a predetermined lowered position and into the well bore.

24. The method of claim 23 including the additional step of releasing the restraint on the material and reel means.

25. The method of claim 24 including the additional step of raising the lowered material to its original elevated position whereby the released reel means is rotated to pay out additional reeled material between the reel means and well bore upper end.

26. The method of claim 25 which thereafter includes the additional steps of:
a. locking against rotation the reel means which supports the reeled material; and
b. moving the additional payed out material into the well bore until the elevated material is again pulled downwardly relative to the well bore upper end while the reel means is locked against rotation.

27. The method of claim 26 which thereafter includes sequentially repeating the steps recited in claims 23, 24 and then claim 25 until the desired extent of material from the reel means has been moved into the well bore.

28. The method of claim 22 wherein the movement of the material into the well bore is accomplished by pulling it in.

29. Apparatus for controlling movement of reeled material into or from a well bore alongside pipe to which the reeled material is connected including:
a. reel means on which the material is reeved;
b. movable pulley means supporting the material between said reel means and the well bore;
c. means to lower said movable pulley means as the material supported thereby is pulled into the well bore alongside the pipe in relation to the rate of movement of pipe into the well bore;
d. means to raise said movable pulley means as the material supported thereby is removed from the well bore in relation to the rate of movement of pipe out of the well bore; and
e. means to restrain said reel means against rotation as the material and pipe is moved into and removed from the well bore.

30. Apparatus for moving a well string composed of tubular joints upwardly relative to a well bore in the earth's surface while simultaneously retrieving material connected to the well string from the well bore including:
a. engaging means engageable with a tubular joint to pull it upwardly relative to the well bore;
b. support means connected to said engaging means to raise said engaging means relative to the well bore upper end;
c. reel means for receiving the material retrieved from the well bore;
d. movable means supporting the material which extends between its connection to the well string and said reel means; and e. pulley support means connected to said movable pulley means to position said movable pulley means in a lowered postion in relation to the well bore upper end and to accommodate raising of said pulley means and the material supported thereby to a predetermined elevated position relative to said well bore upper end whereby a length of the material is pulled from the well bore when the well string tubular joint is pulled upwardly relative to the well bore upper end without rotating said reel means.

31. Apparatus as recited in claim 30 including reel restraining means to restrain rotation of said reel means as said movable means is raised to pull the material from the well bore end wherein said movable means includes pulley means and said pulley support means includes a flexible line with one end supporting said pulley means.

32. Apparatus as recited in claim 31 including:

a. reel restraining means to restrain rotation of said reel means as said movable pulley means is raised to its elevated position; and b. reel release means to release said reel restraining means when said movable pulley means is in its elevated position.

33. Apparatus as recited in claim 31 including means to stop raising said movable pulley means when said movable pulley means reaches its predetermined elevated position.

34. Apparatus as recited in claim 31 including:

a. means to rotate said reel means to reeve thereon the material pulled from the well bore by said elevated movable pulley means, said means including:

1. motor means; and 2. clutch means to engage said motor means and said reel means for rotation of said reel means;

b. actuating means operatively associated with said movable support means to accommodate lowering of said movable pulley means in response to the force exerted thereon by the material supported thereby as it is reeved onto said rotating reel means;

c. pulley restraining means operable by said actuating means to restrain lowering of said movable pulley means; and d. pulley release means to release the restraint on said movable pulley means when it has reached its lowered position.

35. Apparatus as recited in claim 34 wherein said pulley restraining and pulley release means includes:

a. a power source;

b. power actuated brake means connected with said power source to control rotation of said drum rotating means; and c. control means to control the flow of power from said source to said brake means to selectively actuate and release said brake means to selectively restrain and to release the restraint on said movable pulley means.

36. Apparatus as recited in claim 35 wherein said power source is fluid and said drum rotating means, motor means to rotate said reel means, clutch means and brake means are fluid actuated.

37. Apparatus as recited in claim 35 wherein said power source is electrical and said drum rotating means, motor means to rotate said reel means, clutch means and brake means are electrically actuated.

38. Apparatus of claim 30 wherein said pulley support means includes:

a. flexible line means having one end connected to said movable means;

b. additional movable means mounted in fixed position above said movable means and over which said flexible line means extends;

c. drum means on which said flexible line means is reeved; and d. drum rotating means to reeve said pulley flexible line means thereon and raise said movable pulley means to its elevated position.

39. Apparatus as recited in claim 32 including:

a. a source of power;

b. said drum rotating means including motor means actuatable by said power source;

c. power operated clutch means connected with said power source for connection of said drum means with said drum rotating means whereby said drum means may be rotated to reeve said pulley cable means thereon as said movable pulley means is raised to its elevated position; and d. control means to control the flow of power from said source to said clutch and drum rotating means for rotation of said drum means.

40. A method of moving reeled material into and out of a well bore alongside a well bore to which the material is connected, comprising the steps of:

a. supporting the material which extends between the well bore and the reel on movable means;

b. supporting the material which extends between the well bore and the reel on movable means;

c. lowering the movable means as the material supported thereon is pulled into the well bore alongside the well string in relation to the rate of movement of the wall string into the well bore; and d. raising the movable means and material supported thereon in relation to the rate of movement of the well string out of the well bore.

41. A method of controlling movement of material into and out of a well bore comprising the steps of:

a. supporting the material on a reel;

b. supporting the material which extends between the well bore and the reel on movable means;

c. restraining against rotation the reel which supports the material as the supported material is moved into and retrieved from the well bore;

d. lowering the movable means and supported material thereon to move the material into the well bore;

e. releasing the reel for rotation after the movable means and supported material thereon have been lowered to move the material into the well bore; and f. raising the movable means and supported material thereon to pull additional material from the reel whereby the additional material may thereafter be lowered into the well bore.

42. A method of controlling movement of material into and out of a well bore comprising the steps of:

a. supporting the material on a reel;

b. supporting the reeled material which extends between the well bore and the reel on movable means;

c. restraining against rotation the reel which supports the material as the supported material is moved into and retrieved from the well bore;

d. releasing the reel for rotation after the movable means and supported material thereon have been lowered to move the material into the well bore;

e. raising the movable means and supported material thereon to pull additional material from the reel whereby the additional material may be removed from the well bore; and f. rotating the reel to reeve thereon the material removed from the well bore.

43. The method of claim 42 wherein rotation of the reel also effects lowering of the movable means and material thereon to position the movable means and material for removal of additional material from the well bore.

44. In apparatus for controlling movement of reeled material into and out of a well bore alongside a well string to which the material is connected, the invention comprising:

a. means to acommodate movement of the material into the well bore alongside the well string in relation to the rate of movement of the well string into the well bore; and b. means to accomodate movement of the material from the well bore in relation to the rate of movement of the well string out of the well bore.

45. In apparatus for controlling movement of reeled material into and out of a well bore alongside a well string to which the material is connected, the invention comprising:

a. means to accommodate movement of the material into the well bore alongside the well string in relation to the rate of movement of the well string into the well bore; and b. means to accommodate movement of the material from the well bore in relation to the rate of movement of the well string out of the well bore.

46. A method of simultaneously lowering a well bore string into the upper end of a well bore along with material which extends from reel means and which material has one end connected to the well string comprising the steps of:

a. supporting the well string in the well bore in an initial predetermined position;

b. supporting the material extending between its connection to the well string and the reel means in position relative to the well bore upper end to accommodate downward movement thereof into the well bore;

c. lowering the well string into the well bore to pull the material into the well bore; and d. maintaining the reel means which supports the material in nonrotating relation as the well string and material are lowered into the well bore.

47. A method of simultaneously lowering a well string formed of a plurality of end-to-end connected tubular joints into the upper end of a well bore along with a portion of material which is carried by and extends from the reel means with an unreeled end of the reeved material connected to the well string comprising the steps of:

a. supporting the well string in the well bore in initial position with an upright tubular joint thereof extending above the upper end of the well bore;

b. supporting the material portion extending between its connection with the well string and the reel means in a predetermined elevated position relative to the well bore upper end to accommodate downward movement thereof; and c. lowering the well string and upright tubular joint into the well bore to pull into the well bore alongside the tubular member a portion of the material supported in an elevated position.

48. A method of moving material connected to a well string into the upper end of a well bore in the earth's surface, which material is reeved on rotatable reel means while inhibiting flywheel effect associated with rotating reel means comprising the steps of:

a. supporting the portion of material which extends between the reel means and the well bore in an elevated portion relative to the well bore upper end to accommodate downward movement thereof; and b. moving a length of the elevated material which extends between the reel means and well bore into the upper end of the well bore until the elevated material is moved downwardly relative to the well bore upper end without rotating the reel means on which the material is reeved.

49. Apparatus for controlling movement of reeled material into or from a well bore alongside pipe to which the reeled material is connected including:

a. reel means on which the material is reeved;

b. movable pulley means supporting the material between said reel means and the well bore;

c. means to lower said movable pulley means as the material supported thereby is pulled into the well bore alongside the pipe in relation to the rate of movement of pipe into the well bore;

d. means to raise said movable pulley means as the material supported thereby is removed from the well bore in relation to the rate of movement of pipe out of the well bore; and e. means to restrain said reel means against rotation as the material and pipe is moved into and removed from the well bore.

* * * * *